US007435116B2

(12) United States Patent
Wang

(10) Patent No.: US 7,435,116 B2
(45) Date of Patent: Oct. 14, 2008

(54) ELECTRICAL CARD CONNECTOR

(75) Inventor: Long-Fei Wang, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/786,118

(22) Filed: Apr. 10, 2007

(65) Prior Publication Data

US 2007/0238338 A1 Oct. 11, 2007

(30) Foreign Application Priority Data

Apr. 10, 2006 (TW) ..... 95205942 U

(51) Int. Cl.
*H01R 29/00* (2006.01)

(52) U.S. Cl. ..... 439/188

(58) Field of Classification Search ..... 439/188, 439/326, 159, 157, 489
See application file for complete search history.

(56) References Cited

U.S. PATENT DOCUMENTS 6,381,338 B1 * 4/2002 Ou ..... 381/365
6,544,074 B2 * 4/2003 Bricaud et al. ..... 439/630
6,568,960 B2 * 5/2003 Bricaud et al. ..... 439/630
6,896,532 B2 * 5/2005 Chang ..... 439/188
7,101,206 B2 * 9/2006 Chang ..... 439/188
2004/0127081 A1 * 7/2004 Chou ..... 439/188

* cited by examiner

*Primary Examiner*—Alexander Gilman
(74) *Attorney, Agent, or Firm*—Wei Te Chung

(57) ABSTRACT

An electrical card connector (1) includes a housing (10) having a main body (13), and first and second sidewalls (11,12) substantially parallel extending forwards form opposite ends of the main body; the main body defining a receiving cavity together with the first and second sidewalls for receiving an electrical card, a plurality of terminals (20) disposed in the housing and each having a connect portion (21) extending into the receiving cavity for contacting the card, and a pair of switching terminals (41, 42) engaged with the housing and each defining a contacting portion to connect with each other, and a cover (50) engaged with the housing and covering onto the contacting portions of the switching terminals.

20 Claims, 2 Drawing Sheets

ELECTRICAL CARD CONNECTOR

BACKGROUND OF THE INVENTION

1. Field of the Invention

The present invention relates to electrical connectors, especially to a card connector provided for electrically connecting a card to a circuit board.

2. Description of Related Art

In electronic appliances, such as portable telephones, PDA, digital cameras and the like, addition of a variety of functions and identification of a user are achieved by inserting an IC card with a built-in IC, such as a SIM (subscriber identify module) card, an MMC (multimedia card), an SD (secure digital or super density) card, an MS (memory stick) card and the like therein. Such an IC card is usually connected to the circuit board via a card connector.

The IC card of this kind normally has some means for inhibiting the write operation in order to protect information stored in its internal memory. A means is also provided to cancel the write protection to allow information to be written from an electronic device into the memory of the IC card. In order to contact or cut electrically between IC card and the electronic device accurately and conveniently, the card connector commonly equips with switches to achieve above-mentioned object.

U.S. Pat. No. 6,135,809 shows a conventional card connector comprising an insulative housing, a plurality of terminals retained in the housing, and a detecting device positioned on one side of the housing for detecting of a card. The housing defines a main body and a pair of sidewalls parallel to each other and extending forwards from two opposite sides of the main body and defining a receiving space therebetween for receiving an IC card therein. The main body defines a plurality of passageways therethrough for receiving corresponding terminals therein. The detecting device is engaged with one side of the housing for detecting the IC card out and comprises a first piece of metal made from a stationary piece of metal having a first contacting portion; and a second piece of metal having a second contacting portion, the first and second contacting portions can come in contact with each other before the IC card is inserted into the receiving space of the housing. At this time, the IC card is on a protect-on position (write inhibit position). The first and second contacting portions can separate from each other when the IC card is completely inserted into the receiving space of the housing. At this time, the IC card is on a protect-off position (write enable position).

However, because the first piece meets with the second piece simply to connect each other, dust and other matter residing on both of communication portions thereof cannot be cleared automatically so that the connecting performance is not reliable. Furthermore, when the IC card is detected or inserted manually frequently, fingers of users' are easy to touch the first and second contacting portions of corresponding pieces thereby reducing conductivity of the detecting device or damaging the detecting device.

Therefore, an improved card connector is desired to overcome the disadvantages of the prior arts.

SUMMARY OF THE INVENTION

An object of the present invention is to provide a card connector in which wear damage of corresponding switch thereof due to insertion or ejection movement of IC cards can be reduced.

In order to achieve above-mentioned object, an electrical card connector in accordance with a preferred embodiment of the present invention comprises an insulative housing defining a main body defining a plurality of passageways for receiving corresponding terminals therein and first and second sidewalls substantially parallel extending forwards from two opposite sides of the main body, a plurality of terminals received in the housing and each having a contact portion extending into the receiving cavity for contacting the electrical card, a pair of hooks engaged with the housing defining a receiving cavity together with the main body, the first and second sidewalls for receiving an electrical card therein, a detecting device mounted onto the housing and a cover partly covered onto the housing for covering the detecting device. The detecting device comprises a first switch and a second switch engaged with the first switch during the card inserting into the receiving cavity. The cover comprises a base for substantially covering corresponding contacting portions of the first and second switch, and a pair of protrusions extending downwardly from two opposite lateral edges thereof, for engaged with corresponding cutouts of the housing to secure the cover onto the housing.

Other objects, advantages and novel features of the present invention will become more apparent from the following detailed description of the present embodiment when taken in conjunction with the accompanying drawings.

DETAILED DESCRIPTION OF THE INVENTION

Figure 1:
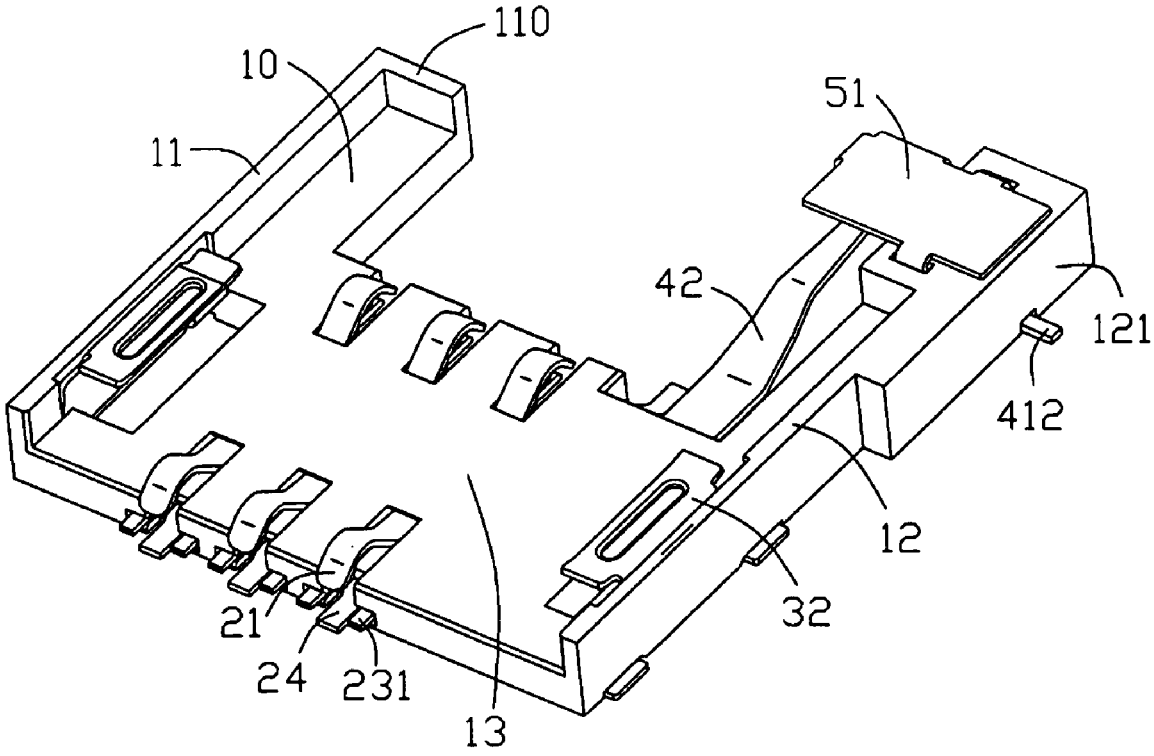
FIG. 1 is an assembled perspective view of a card connector in accordance with the preferred embodiment of the present invention.

Reference will now be made to the drawing figures to describe the preferred embodiment of the present invention in detail.

Figure 2:
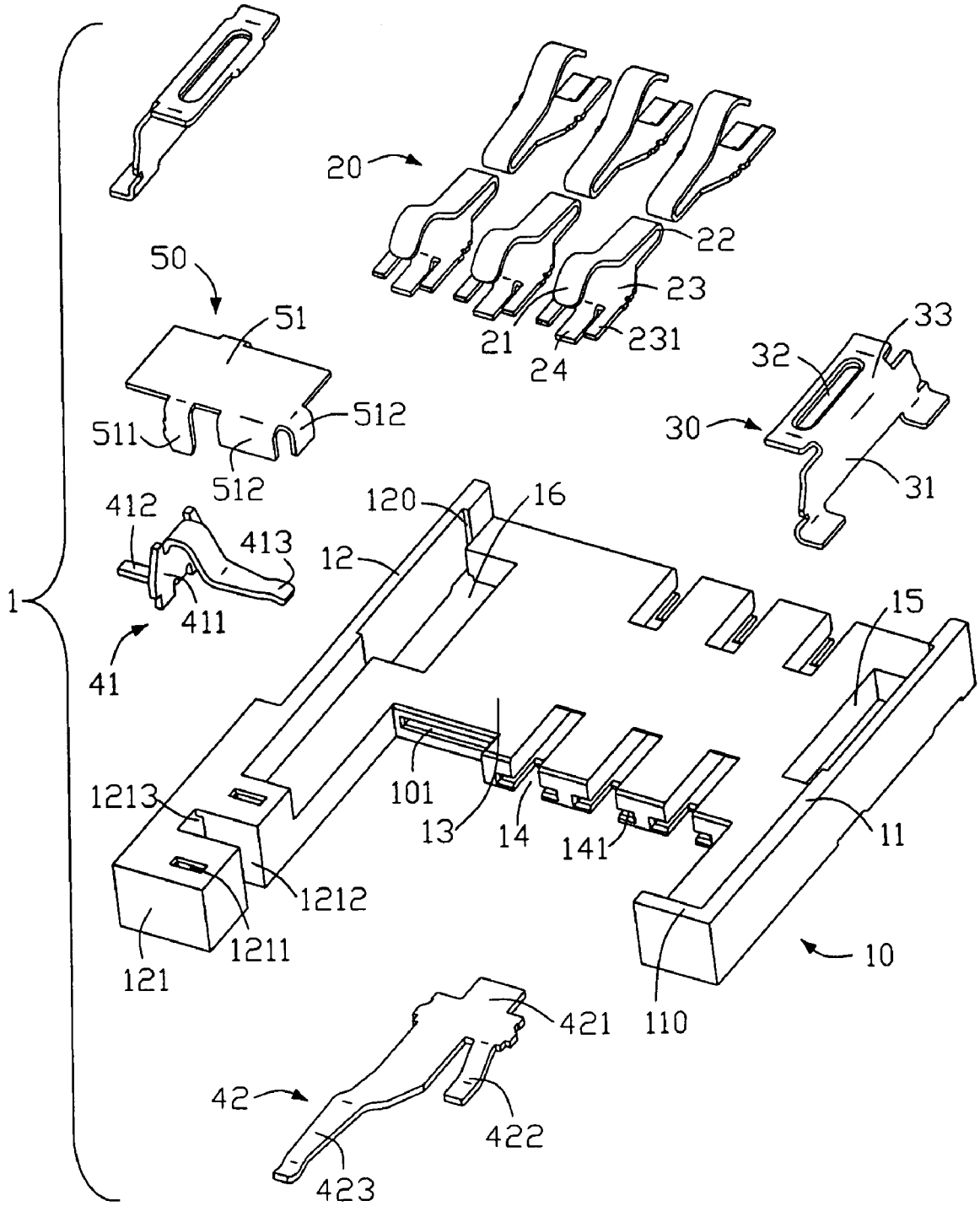
FIG. 2 is an exploded, perspective view of the card connector of FIG. 1.

Referring to FIGS. 1 and 2, a card connector 1 for connecting a card (not shown) to a circuit board (not shown) in accordance with the preferred embodiment of the present invention comprises an insulative housing 10, a plurality of terminals 20 received in the housing 10, a detecting device (not labeled) received in a front portion of the housing 10, a pair of hooks 30 engaged with two opposite ends of the housing 10, and a cover 50 engaged with the housing 10 for covering on top of the detecting device.

The housing 10 defines a main body 13, a first sidewall 11 and a second sidewall 12 extending from two opposite sides of the main body 13, which together define an upward receiving cavity (not labeled), for receiving the card therein. The main body 13 defines a plurality of passageways 14 for receiving the corresponding terminals 20 therein. Each passageway 14 defines a pair of notches 141 on two opposite inner surfaces thereof. A second switching recess 101 is formed at a front portion of the housing 10 and adjacent to the passageway 14 near to the second sidewall 12. A pair of cavities 15, 16 are defined on respective connecting areas connecting the main body 13 and the first or second sidewalls 11, 12 close to their respective rear portions. A pair of slots 120 are formed on respective inner surfaces of the first and second sidewalls 11, 12 toward to the corresponding cavities 15, 16 for engaging with the hooks 30. The first sidewall 11 defines a first flange 110 at its front portion thereof, while the second sidewall 12 also defines a second flange 121 at its front portion thereof so as to make the second sidewall 12 longer than the first sidewall 11 along front-to-back direction. A pair of cutouts 1211 are defined on an upper surface of the second flange 121 and an opening 1212 is formed between the cutouts 1211 thereof. A first switching recess 1213 is formed between the opening 1212 and the inner surface of the second sidewall 12.

Each of the terminal 20 comprises a retaining portion 23, a connecting portion 21 extending slantly and upwardly from one end of the retaining portion 23 and a soldering portion 24 extending from the opposite end of the retaining portion 23. A connection portion 22 is curvedly connected between the connecting portion 21 and the retaining portion 23. A pair of securing portions 231 are formed on two sides of the soldering portion 24 for wedging into the corresponding notches 141 of the passageways 14.

Each hook 30 is engaged with the corresponding slot 120 of the first and second sidewalls 11, 12 and defines a securing portion 31 having two soldering legs (not labeled) formed at one end thereof, a planar portion 32 extending from the opposite end of the securing portion 31 and a connecting portion 33 arcuately connecting the securing portion 31 and the planar portion 32. The planar portion 32 is cooperated with the main body 13, the first and second sidewalls 11, 12 of the housing 10 to form the receiving cavity for receiving the card therein. The soldering legs of the securing portion 31 are provided to solder the hook 30 onto the PCB.

The detecting device is used for detecting whether the card is completely assembled, and includes a first switching terminal 41 and a second switching terminal 42 which can be either connected together or separate from each other. The first switching terminal 41 comprises a first base portion 411 with an H-shaped configuration having two pair of protrusions (not labeled) on opposite ends thereof, a first mounting leg 412 extending outwardly from a bottom end of the first base portion 411 and formed between the pair of protrusions, a first contacting portion 413 extending reversedly outward from an upper end of the first base portion 411 and formed between the other pair of protrusions. The second switching terminal 42 comprises a second base portion 421 with a T-shaped configuration also having a pair of barbs (not labeled) at opposite lateral ends thereof, a second mounting leg 422 extending toward to the first and second flanges 110, 121 from one side of the base portion 421, and a second contacting portion 423 extending outward from the same side of the second base portion 421 along a same direction as the second mounting leg 422. The first and second switching terminals 41, 42 can engage with the housing 10 via the corresponding first and second base portions 411, 421 interferentially securing into the first and second switching recesses 1213, 101 of the housing 10.

The cover 50 defines a rectangular base 51 for substantially covering corresponding the first and second contacting portions 413, 423 of the first and second switch terminals 41, 42, and a pair of protrusions 511 extending downwardly from two opposite lateral edges along its longitudinal direction thereof, for engaging with corresponding cutouts 1211 of the housing 10 to secure the cover 50 onto the housing 10. A pair of blocks 512 are formed at a corner adjacent to one of the protrusions 511 thereof.

In assembly, the terminals 20 are firstly assembled into corresponding passageways 14 at the main body 13 of the housing 10 via the securing portions 231 of the terminal 20 wedging into the corresponding notches 141 of the passageways 14. Then the first and second switching terminals 41, 42 are respectively fixed onto the housing 10 via the corresponding first and second base portions 411, 421 interferentially engaged into corresponding first and second switching recesses 1213, 101. Then the hook 30 is mounted onto the housing 10 via the securing portion 31 received in the slot 120. Lastly, the cover 50 is disposed on top of the second flange 121 with its protrusion 511 engaged with the cutout 1211 so as to substantially cover over the contacting portions 413, 423 of the switching terminals 41, 42. In normal position before the card insertion into the receiving cavity, the first contacting portion 413 of the first switching terminal 41 and the second contacting portion 423 of the second switching terminal 42 are in disengagement with each other.

When the card is inserted into the receiving cavity with its two side surfaces sliding against the inner surfaces of the first and second sidewalls 11, 12 to substantially contact with the connecting portion 21 of the terminal 20, the contacting portions 413, 423 are in engagement with each other. Because the contacting portions 413, 423 are substantially covered by the base 51 of the cover 50, when the card is detected manually frequently, fingers of a user will not touch the first and second contacting portions 413, 423 of the corresponding first and second switching terminals 41, 42. Reliable conductivity of the first and second switching terminals 41, 42 is thus obtained.

However, the disclosure is illustrative only, changes may be made in detail, especially in matter of shape, size, and arrangement of parts within the principles of the invention.

I claim:

1. An electrical card connector comprising:

an insulative housing having a main body, and first and second sidewalls substantially extending in parallel forwards from opposite ends of the main body;

a pair of hooks engaged with the first and second sidewalls of the housing and, together with the main body, the first and second sidewalls, defining a receiving cavity for receiving an electrical card;

a plurality of terminals disposed in the housing and having contact portions extending into the receiving cavity for contacting the electrical card; and a pair of switching terminals mounted on a front portion of the housing and each defining a contacting portion, and the contacting portions separated from each other in vertical direction without a card in the receiving cavity and engaged with each other in vertical direction during insertion of the electrical card into the receiving cavity;

wherein a cover is mounted onto the corresponding front portion of the second sidewall and defines a base extending toward the receiving cavity horizontally and substantially over the contacting portions of the switching terminals at a corresponding front portion of the connector to prevent a user's fingers front touching the contacting portions of the switching terminals.

2. The electrical card connector as described in claim 1, wherein the cover defines a pair of protrusions extending from opposite edges of the base.

3. The electrical card connector as described in claim 2, wherein a pair of blocks are formed at a corner of the base.

4. The electrical card connector as described in claim 1, wherein the first switching terminal comprises a first base portion of an H-shaped configuration having two pairs of protrusions on opposite ends thereof, a first mounting leg extending outwardly from a bottom end of the first base portion and formed between one pair of protrusions, a first contacting portion extending reversedly outward from an upper end of the first base portion and formed between the other pair of protrusions.

5. The electrical card connector as described in claim 1, wherein the second switching terminal comprises a second base portion of a T-shaped configuration also having a pair of barbs at opposite lateral ends thereof, a second mounting leg extending from one side of the base portion, and a second contacting portion extending outward from the same side of the second base portion along a same direction as the second mounting leg.

6. The electrical card connector as described in claim 1 , wherein the main body defines a plurality of passageways for receiving corresponding terminals therein, each passageway defining a pair of notches on two opposite inner surfaces thereof.

7. The electrical card connector as described in claim 6; wherein a pair of cavities are defined on respective rear connecting areas connecting the main body and the first or second sidewalls close to their respective rear portions, and a pair of slots are formed on respective inner surfaces of the first and second sidewalk facing corresponding cavities for engaging with the hooks.

8. The electrical card connector as described in claim 7, wherein the first sidewall defines a first flange at its front portion thereof and the second sidewall also defines a second flange at its front portion thereof, the second sidewall being longer than the first sidewall along front-to-back direction.

9. The electrical card connector as described in claim 8, wherein a pair of cutouts are defined on an upper surface of the second flange defined on one end of the second sidewall and an opening is formed between the cutouts thereof.

10. The electrical card connector as described in claim 9, wherein a first switching recess is formed between the opening and the inner surface of the second sidewall and a second switching recess is formed at a front portion adjacent to the passageway near the second sidewall.

11. The electrical card connector as described in claim 6, wherein the terminal comprises a retaining portion, a connecting portion extending slantly and upwardly from one end of the retaining portion, and a soldering portion extending from the opposite end of the retaining portion.

12. The electrical card connector as described in claim 11, wherein a pair of securing portions are formed on two sides of the soldering portion and wedge into corresponding notches of the passageway.

13. The electrical card connector as described in claim 1, wherein the hook defines a securing portion having two soldering legs fanned at one end thereof, a planar portion extending from the opposite end of the securing portion.

14. An electrical connector comprising:

an insulating housing defining two side arms and a bottom wall commonly defining a card receiving space;

a plurality of signal contacts disposed in the housing with contacting portions extending into the card receiving space;

a recess formed in a rear portion of the housing behind the signal contacts;

a pair of switch contacts mounted in the housing adjacent to said recess with contacting portions extending into the card receiving space;

a cover downwardly covering a portion of top face of the housing and a portion of said switching contacts; and wherein a pair of cavities are defined on respective connecting areas connecting the bottom wall and the side arms, and a pair of slots are formed on respective inner surfaces of the sidearms facing the corresponding cavities for engaging with hooks, respectively.

15. The electrical card connector as claimed in claim 14, wherein said cover is located at a rear corner of the housing.

16. The electrical connector as claimed in claim 14, wherein each of said hooks defines a Z-like configuration in an elevational view, including an upper planar portion for downwardly confining an electronic card, a middle vertical securing portion for securing to the housing, and a lower outward soldering portion for mounting to a printed circuit board, under a condition that the corresponding cavity is dimensioned to allow the upper planar portion to pass when said hook is upwardly assembled to the housing from a bottom face of said housing.

17. An electrical card connector comprising:

an insulative housing having a main body, and first and second sidewalls substantially parallelly extending forwards from opposite ends of the main body, and defining a plurality of passageways therein, each passageway defining a pair of notches on two opposite inner surfaces thereof;

a pair of hooks engaged with the first and second sidewalls of the housing and, defining a receiving cavity together with the main body, the first and second sidewalls for receiving an electrical card;

a plurality of terminals disposed in passageway of the housing and having contact portions extending into the receiving cavity for contacting the electrical card;

a pair of switching terminals assembled within the housing and each defining a contacting portion, and the contacting portions engaged with each other during insertion of the electrical card into the receiving cavity;

a cover is mounted onto one end of the second sidewall and defining a base substantially over the contacting portions of the switching terminals; and wherein a pair of cavities are defined on respective rear connecting areas connecting the main body and the first or second sidewalls close to their respective rear portions, and a pair of slots are formed on respective inner surfaces of the first and second sidewalls facing corresponding cavities for engaging with the hooks.

18. The electrical card connector as described in claim 17, wherein the first sidewall defines a first flange at its front portion thereof and the second sidewalk also defines a second flange at its front portion thereof, the second sidewall being longer than the first sidewall along front-to-back direction.

19. The electrical card connector as described in claim 18, wherein a pair of cutouts are defined on an upper suites of the second flange defined on one end of the second sidewall and an opening is formed between the cutouts thereof.

20. The electrical card connector as described in claim 19, wherein a first switching recess is formed between the opening and the inner surface of the second sidewall and a second switching recess is formed at a front portion adjacent to the passageway near the second sidewall.

* * * * *